US006986733B2

(12) United States Patent
Beyer et al.

(10) Patent No.: US 6,986,733 B2
(45) Date of Patent: Jan. 17, 2006

(54) SOLID BOWL HELICAL CONVEYOR CENTRIFUGE WITH A PRESSURIZED HOUSING

(75) Inventors: Hans-Joachim Beyer, Ennigerloh (DE); Alfons Monkenbusch, Oelde (DE); Michael Reichenbach, Köln (DE); Michael Müller, Dinslaken (DE)

(73) Assignee: Westfalia Separator Industry GmbH, (DE)

( * ) Notice: Subject to any disclaimer, the term of this patent is extended or adjusted under 35 U.S.C. 154(b) by 0 days.

(21) Appl. No.: 10/816,033

(22) Filed: Apr. 1, 2004

(65) Prior Publication Data

US 2004/0185999 A1 Sep. 23, 2004

Related U.S. Application Data

(63) Continuation of application No. PCT/EP02/09993, filed on Sep. 6, 2002.

(30) Foreign Application Priority Data

Oct. 2, 2001 (DE) ..... 101 48 774

(51) Int. Cl.
*B04B 1/20* (2006.01)
*B04B 7/02* (2006.01)

(52) U.S. Cl. ..... 494/41; 494/53; 494/60

(58) Field of Classification Search ..... 494/38, 494/39, 41, 53, 54, 56, 60, 61; 210/380.1, 210/380.3

See application file for complete search history.

(56) References Cited

U.S. PATENT DOCUMENTS

| | | | | |
|---|---|---|---|---|
| 3,399,828 A * | 9/1968 | Fassle | | 494/11 |
| 3,474,955 A * | 10/1969 | Lang et al. | | 494/13 |
| 3,784,091 A * | 1/1974 | Hiller | | 494/27 |
| 3,802,621 A * | 4/1974 | Merzenich | | 494/29 |
| 3,854,658 A | 12/1974 | Probstmeyer | | |
| 3,880,346 A * | 4/1975 | Hopfe | | 494/53 |
| 3,960,318 A * | 6/1976 | Dahlberg | | 494/27 |
| 4,120,447 A * | 10/1978 | Jager | | 494/14 |
| 4,141,488 A * | 2/1979 | Gense | | 494/9 |
| 4,251,023 A * | 2/1981 | Hohne et al. | | 494/60 |
| 4,708,711 A | 11/1987 | Scherer | | |
| 4,784,633 A * | 11/1988 | Bruning et al. | | 494/41 |
| 6,248,055 B1 * | 6/2001 | Ostkamp | | 494/60 |

FOREIGN PATENT DOCUMENTS

| | | |
|---|---|---|
| DE | 4315074 | 11/1984 |
| DE | 3545515 | 5/1987 |
| DE | 3638652 | 6/1988 |
| DE | 19537562 A1 * | 4/1997 |

(Continued)

*Primary Examiner*—Charles E. Cooley
(74) *Attorney, Agent, or Firm*—Gauthier & Connors LLP

(57) ABSTRACT

A solid bowl helical conveyor centrifuge. The centrifuge includes a rotating drum, having a centrifuge space with a screw that can also rotate. An inlet tube for supplying a material for centrifugation into the centrifuge space, and at least one liquid discharge and at least one solids discharge, wherein the liquid discharge and/or the solid discharge is/are designed as at least one or more openings in a rotating part of the solid bowl helical conveyor centrifuge, in particular through openings in the drum wall. At least one of the openings is covered by a housing which encloses the drum of the solid bowl helical conveyor centrifuge in only some sections, between the at least one housing and the drum and/or other rotating elements of the solid bowl helical conveyor centrifuge (drum heads, hubs) at least one or more gaskets are provided.

19 Claims, 7 Drawing Sheets

FOREIGN PATENT DOCUMENTS

| | | | |
|---|---|---|---|
| EP | 640398 A2 * | 3/1995 | |
| EP | 1097750 A2 * | 2/2004 | |
| WO | 03/031073 A1 * | 4/2004 | |
| WO | 03/099446 A1 * | 12/2004 | |

* cited by examiner

SOLID BOWL HELICAL CONVEYOR CENTRIFUGE WITH A PRESSURIZED HOUSING

This application is a Continuation and hereby claims benefit under 35 U.S.C. §120 to the following applications Ser. No. PCT/EP02/09993 filed Sep. 6, 2002.

BACKGROUND OF INVENTION

1. Field of the Invention

This invention relates to a solid bowl or drum helical conveyor centrifuge having a rotating drum, which includes a centrifuge space with a screw that can rotate and having an inlet tube for supplying a material for centrifugation into the centrifuge space.

2. Description of Prior Art

To ensure pressure-tight and airtight operation of a solid drum helical conveyor centrifuge, it is known that the entire drum (i.e., the entire rotating area of the drum) can be surrounded with a housing that is sealed with respect to the environment.

Within this housing, it is possible to maintain the boundary conditions of the process to be carried out and to move the mass flows under the desired pressure conditions.

The friction occurring in particular between the gas molecules and the drum surface, especially at high rotational speeds and/or large diameters of the drum, requires considerable driving power and increases the power consumption by the centrifuge in a manner that is a disadvantage. Another problem is that this energy causes heating of the gas and the rotating part. The wall friction increases in proportion to the increase in pressure and thus there is also an increase in required driving power.

This will now be explained in greater detail on the basis of an example.

If the pressure in a conventional commercial solid bowl helical conveyor centrifuge is increased from 0 bar to 5 bar, for example, it is quite possible for the frictional energy to be increased by a factor of approximately 5 (e.g., from 10 kW to 50 kW or from 100 kW to 500 kW, depending on the diameter and/or the type of machine).

SUMMARY OF THE INVENTION

The object of this invention is therefore to improve upon a generic solid bowl helical conveyor centrifuge such that the driving power applied during operation under pressure is reduced.

This invention achieves this object through a solid bowl helical conveyor centrifuge including a rotating drum having a centrifuge space with a rotatable screw. The centrifuge includes a liquid discharge and a solids discharge wherein only the opening of the solid discharge is covered with a pressure tight housing.

According to this claim, the liquid and/or solid discharge is designed in the form of at least one or more openings in a rotating part of the solid bowl helical conveyor centrifuge, in particular through openings in the wall of the drum, and at least one of the openings is covered by a housing that encloses the drum of the solid bowl helical conveyor centrifuge but only in some sections, with at least one or more gaskets being provided between the at least one housing and the drum and/or other rotatable elements of the solid bowl helical conveyor centrifuge (drum heads, hubs).

According to this invention, the pressure-tight (and thus essentially airtight) housing is preferably reduced only to the area of the at least one (or more) solids discharge and/or liquid discharge. Since the entire exterior space of the drum need no longer be placed under pressure but instead only a portion thereof is placed under pressure on the outside thereof, this reduces the driving power required to operate the solid bowl helical conveyor centrifuge.

The negative effects of an increase in temperature can also be drastically reduced, in particular in a ring-type design of the housing, so that it covers only the openings.

Since most of the drum is in an environment without an elevated pressure due to the process, this results in only a very minor increase in frictional energy. The increase in temperature can be reduced significantly. Furthermore, it is conceivable that additional cooling equipment may be eliminated and/or the cooling power may be reduced.

The solid bowl helical conveyor centrifuge can also be manufactured inexpensively because the pressure-tight housing, that is to be put under pressure, is smaller. The relevant regulations for operation of machinery under increased pressure can also be satisfied more easily.

It is also advantageous that the product area is reduced in size (see FIGS. 2 and 7) because smaller quantities of gas than in the state of the art are used for inertization, for example, and operation with toxic substances is simplified.

Since only a mechanical lining of the drum is needed for protection against electric shock, the cost of manufacturing can be reduced significantly by reducing the cost of materials. In addition, the total construction space required is also reduced.

In particular at least one scraper disk is recommended as the liquid discharges, so that no pressurized housing is necessary in the area of the liquid discharge. The scraper disk could be supplemented by a special pressurized housing.

As an alternative, however, it is also possible to provide one or more housings and gaskets on the side of the liquid discharge to cover the at least one or more liquid discharges.

The gaskets are preferably designed as bearing ring gaskets that surround the outside circumference of the drum, for example, and/or may be in contact with an axial wall of the drum. Bearing ring gaskets ensure a tight seal between the rotating drum and the nonrotating housing.

It is especially preferable for the at least one housing to extend only over the area of the openings of the drum. To do so, it is suggested that the at least one housing be designed in a simple and inexpensive ring shape.

The at least one housing is preferably designed for operation from a pressure of more than 0.5 bar, preferably 3 to 6 bar.

The peripheral velocity of the gaskets is preferably greater than 30 m/sec. The temperature in the pressurized area in processing centrifuged material is preferably more than 50° C., especially 100° C. to 160° C.

BRIEF DESCRIPTION OF THE DRAWINGS

Exemplary embodiments are described in greater detail below on the basis of the drawings, which show.

DETAILED DESCRIPTION OF THE INVENTION

Figure 1:
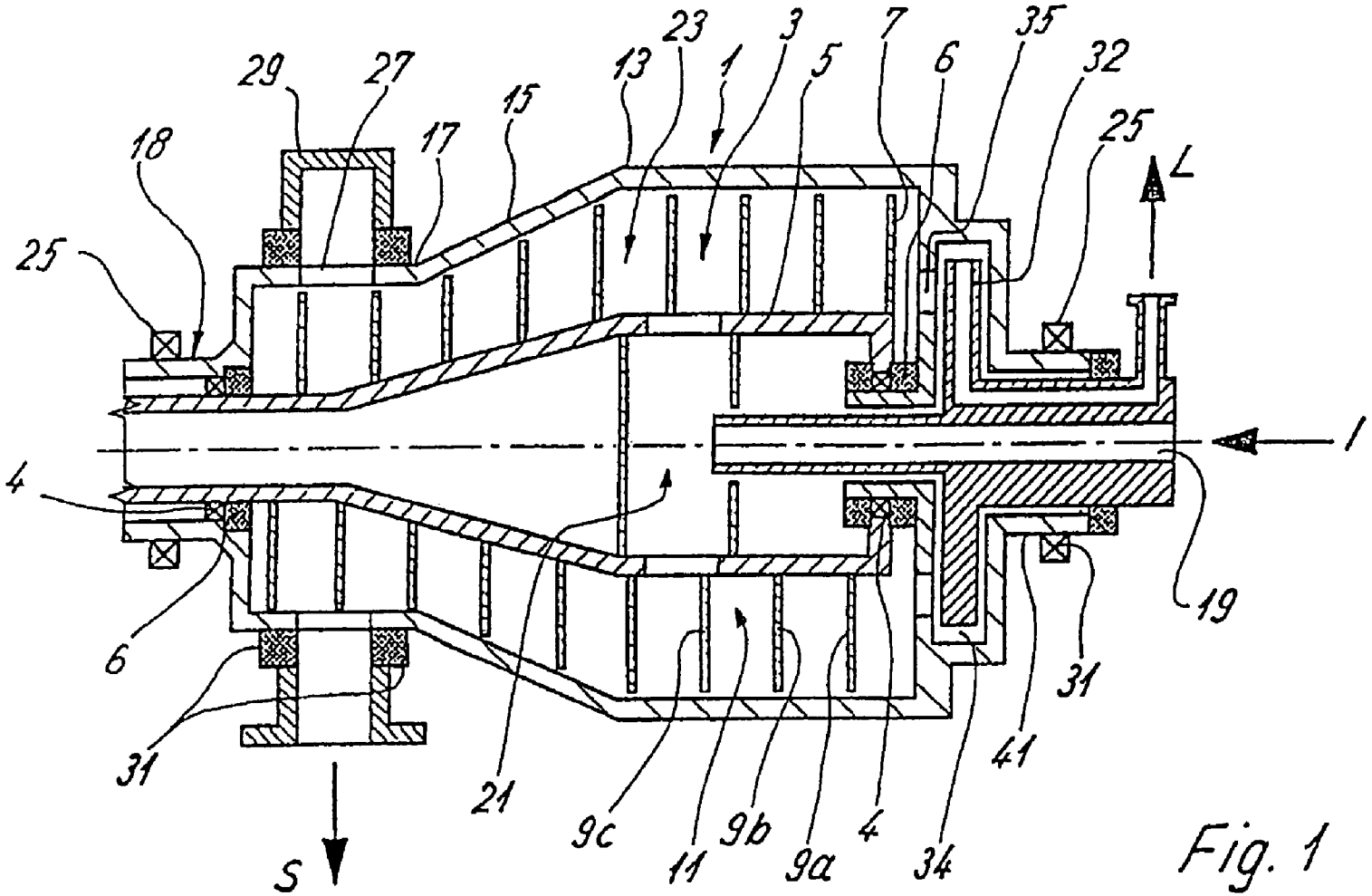
FIG. 1 is a sectional diagram of a first variant of a solid bowl helical conveyor centrifuge.

FIG. 1 shows a solid bowl helical conveyor centrifuge having a bowl or drum 1 and a screw 3 situated in the drum, having a screw body 5 and a screw blade 7 surrounding the screw body 5 in a helix. A channel 11 for conveying/transporting a centrifuged material that is to be processed is provided between the screw threads 9*a*, 9*b*, etc. Bearings 4 and gaskets 6 are provided on both ends of the solid bowl helical conveyor centrifuge between the drum 1 and the screw body 5.

In the rear area in FIG. 1, the centrifuge has a cylindrical section 13 and, in its front area adjacent thereto in FIG. 1, section 15 tapers conically (or in stages). The drum has another cylindrical section 17 adjacent to and in axial connection to the tapering section 15. A drum head 18 (and/or a hub) being connectable to this section 17.

A centrifuged material I is passed through the centrally positioned inlet tube 19 into a distributor 21 and from there through radial openings in the distributor 21 into the centrifuge space 23 with the screw 3 and the drum 1 surrounding the screw 3.

The centrifuged material I is accelerated in its passage through the distributor 21 and in entering the centrifuge space 23. Due to the influence of centrifugal force, solid particles are separated on the wall of the drum.

The screw 3 rotates at a somewhat faster or slower speed than the drum 1 and conveys the solids S that have been separated to the solids discharge and out of the drum 1 via the tapering section 15. The liquid L, however, flows toward the larger drum diameter at the rear end of the drum 1, where it is drained out.

The drum 1 and/or hubs adjacent to it are mounted at their axial ends by means of bearings 25 in a machine frame (not shown here) and are usually provided with a hood or cover (not shown here) to protect the operating person from the rotating parts.

The drum 1 is provided with an opening 27 that points at least radially outward in its peripheral wall for the purpose of discharging the solids.

To be able to operate the drum 1 so that it is pressure-tight and/or under a high pressure, the areas of the solids discharge and the liquid discharge are sealed with respect to the environment according to the idea of this invention.

Figure 6:
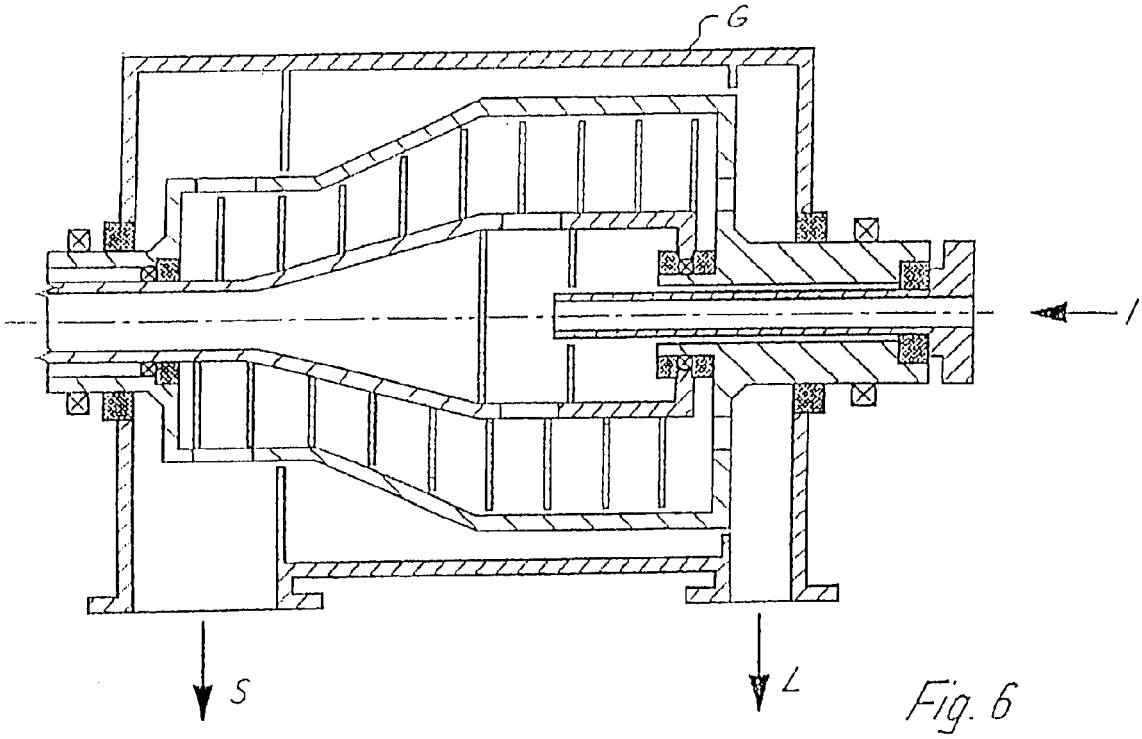
FIG. 6 is a schematic diagram of a solid bowl helical conveyor centrifuge according to the state of the art.

Unlike the technology depicted in FIG. 6, this is not accomplished by the fact that the entire drum is surrounded by a pressure-tight housing G, but instead by a controlled local sealing of the drum in the area of the solids discharge and/or liquid discharge.

Thus, the drum 1 of the exemplary embodiment in FIG. 1 is provided with a ring-like housing 29 in the area of the radial openings 27, said ring-like housing covering the openings axially so that gaskets 31, e.g., bearing ring gaskets, can be arranged between the housing 29 (and/or between the inside circumference of the axial walls of the housing) and the drum 1. This yields a seal between the rotating drum 1 and the stationary housing 29.

On the axial end of the drum opposite the solids discharge, the liquid is removed by means of a scraper disk 32, which ensures a seal of the interior of the drum, in this area during operation, with respect to the outside. The scraper disk 32 is situated in a chamber 34 of the drum 1, which is adjacent to the centrifuge space 23 and is connected to it. The chamber being connected to the drum through at least one opening 35. Another gasket 31 between drum head 41 and the stationary scraper disk 32 (and/or a tubular attachment on the scraper disk) may also be designed as a bearing ring gasket and may thus also ensure the pressure tightness of the drum in this area, even when the drum is at a standstill.

Figure 2:
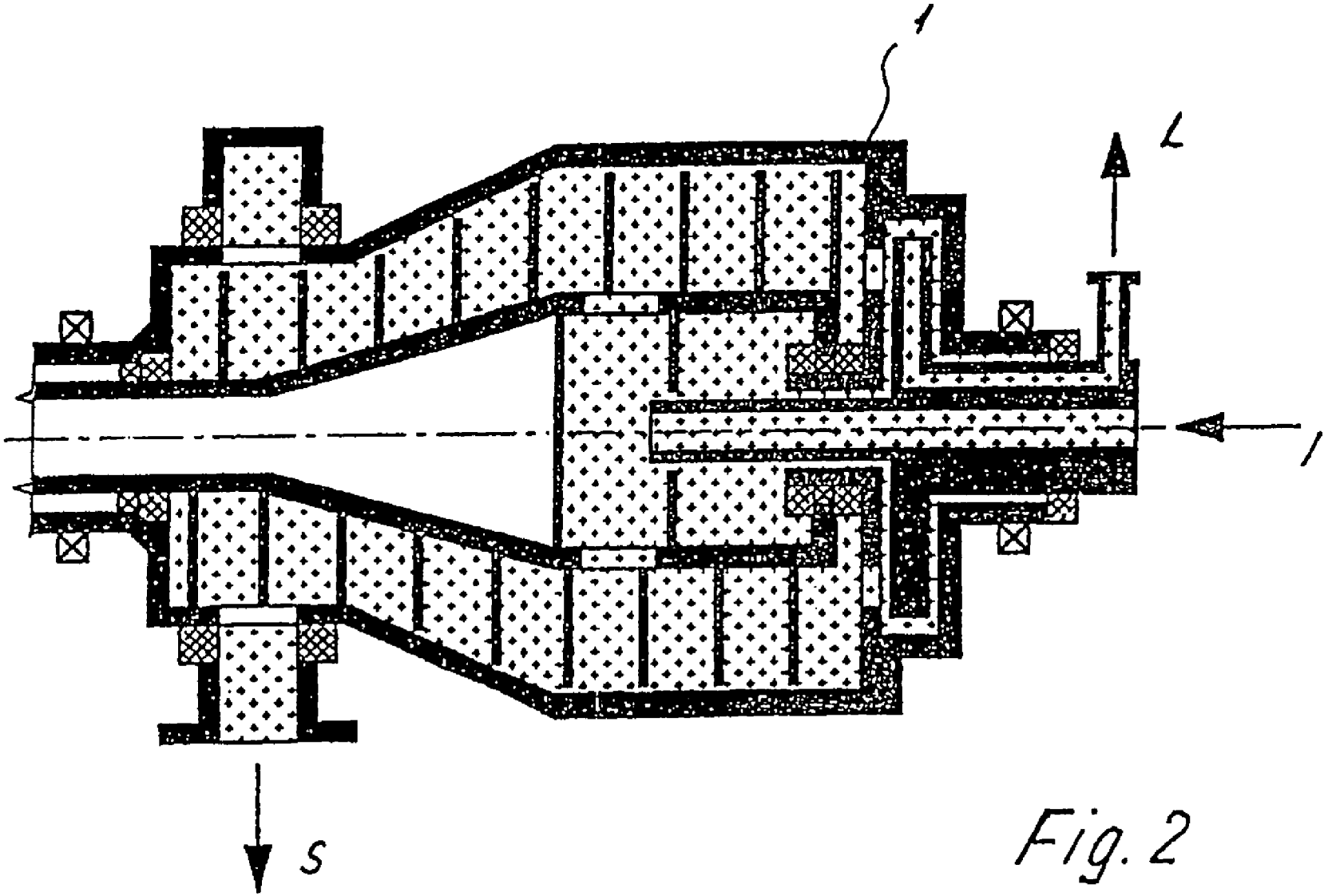
FIG. 2 is the solid bowl helical conveyor centrifuge from FIG. 1, with the high-pressure area shown as a dotted area.

The dotted area in FIG. 2 shows the area that can be operated under pressure. The inlet and outlet lines that are not shown outside of the solid bowl helical conveyor centrifuge are designed for pressurized operation.

Figure 3:
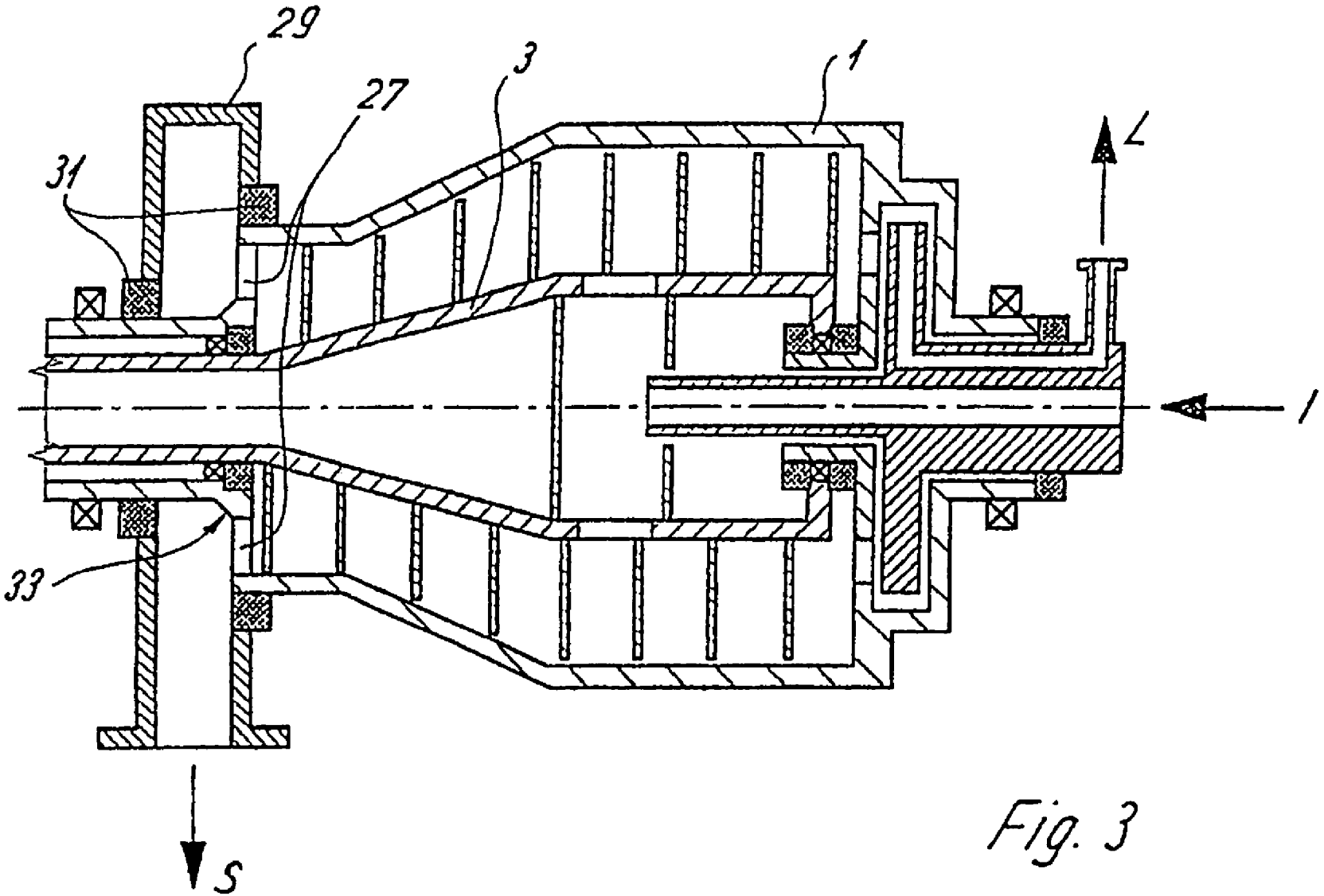
FIG. 3 is a sectional diagram of a second variant of a solid bowl helical conveyor centrifuge.

FIG. 3 differs from the exemplary embodiment in FIG. 1 in that the openings 27 are arranged in the axial drum wall pointing toward the solids discharge side, with the housing 29 in turn covering these axial openings 27. The housing 29 has a ring shape and is sealed with respect to the wall of the drum by means of gaskets 31. The housing 29 also extends over a step 33 in the drum wall housing.

Figure 4:
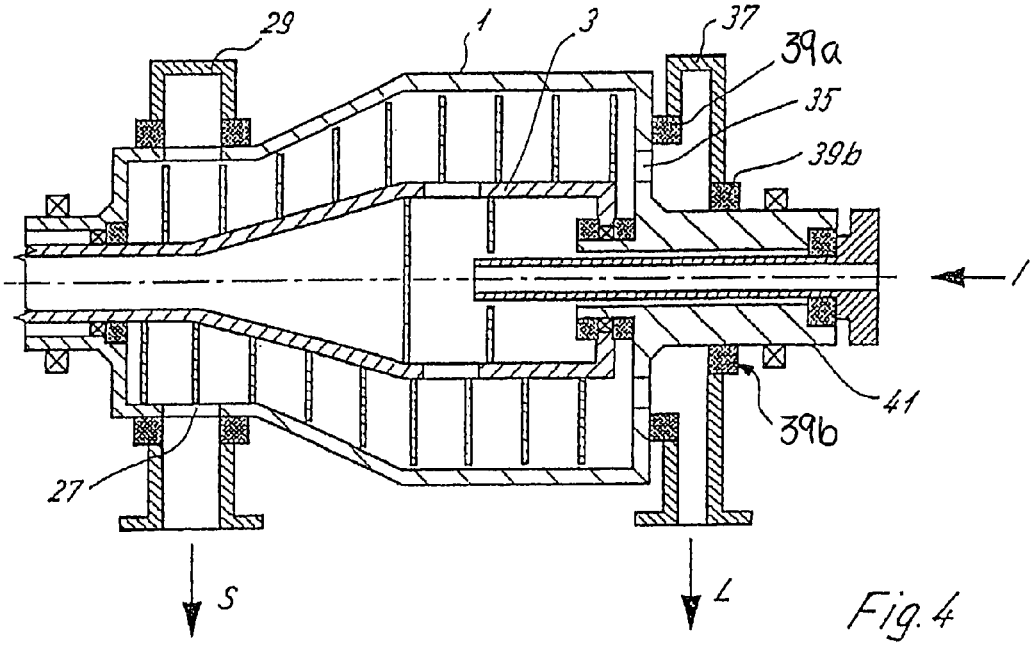
FIG. 4 is a schematic diagram of a third variant of a solid bowl helical conveyor centrifuge.
Figure 5:
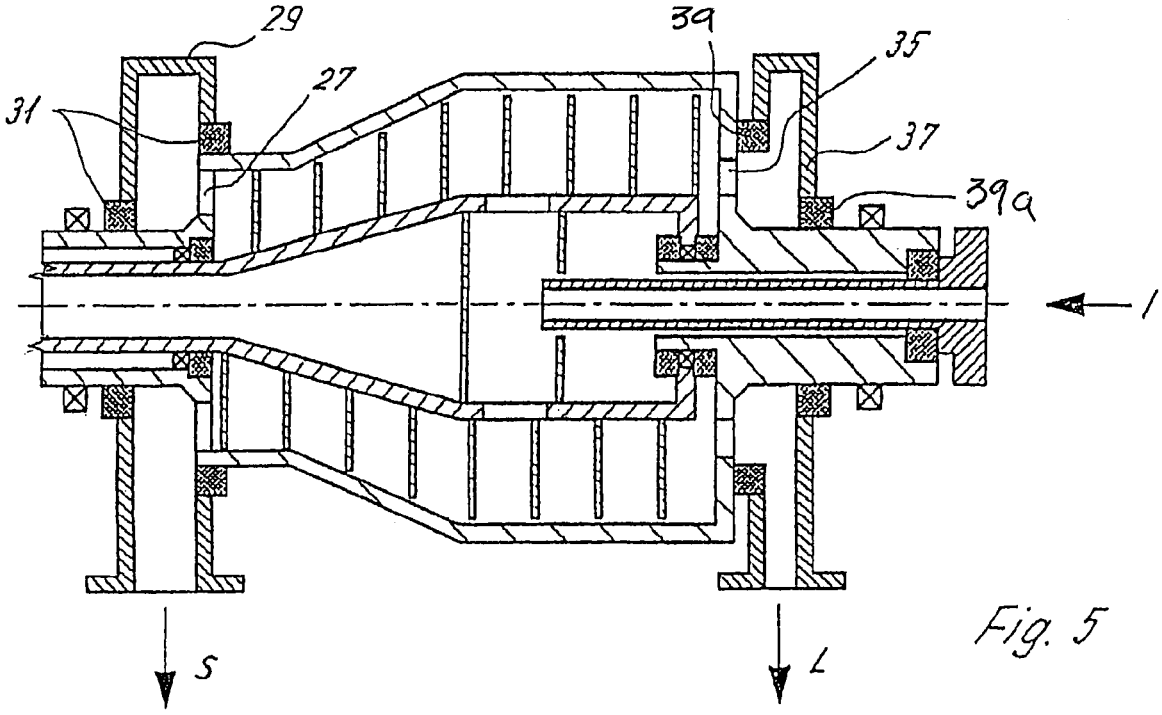
FIG. 5 is a schematic diagram of a fourth variant of a solid bowl helical conveyor centrifuge.

The exemplary embodiments in FIGS. 4 and 5 differ from one another in that the solids discharge in FIG. 4 corresponds to that in FIG. 1, and the solids discharge in FIG. 5 corresponds to that in FIG. 3.

The difference in comparison with FIGS. 1 and 3 is also that the liquid discharge in FIGS. 4 and 5 is not implemented by one or more scraper disks but instead is implemented by at least one or more overflow openings 35 in the axial wall of the drum 1 facing away from the solids discharge.

In order to ensure operation under a high pressure, according to FIGS. 4 and 5 the overflows 35 are also covered by a housing 37, with gaskets 39 (e.g., bearing ring gaskets) being situated between the housing 37 and the outside wall of the drum—and/or other corresponding parts of the machine. One of the gaskets (39*a*) is in contact with the axial end face of the drum wall and the other (39*b*) surrounds a cylindrical drumhead 41 (e.g., a hub) connected to the outside wall of the drum. The drumheads 18, 41 and the drum 1 are schematically depicted as being in one piece. In practice, an implementation involving multiple parts is preferred and is essentially known.

Figure 7:
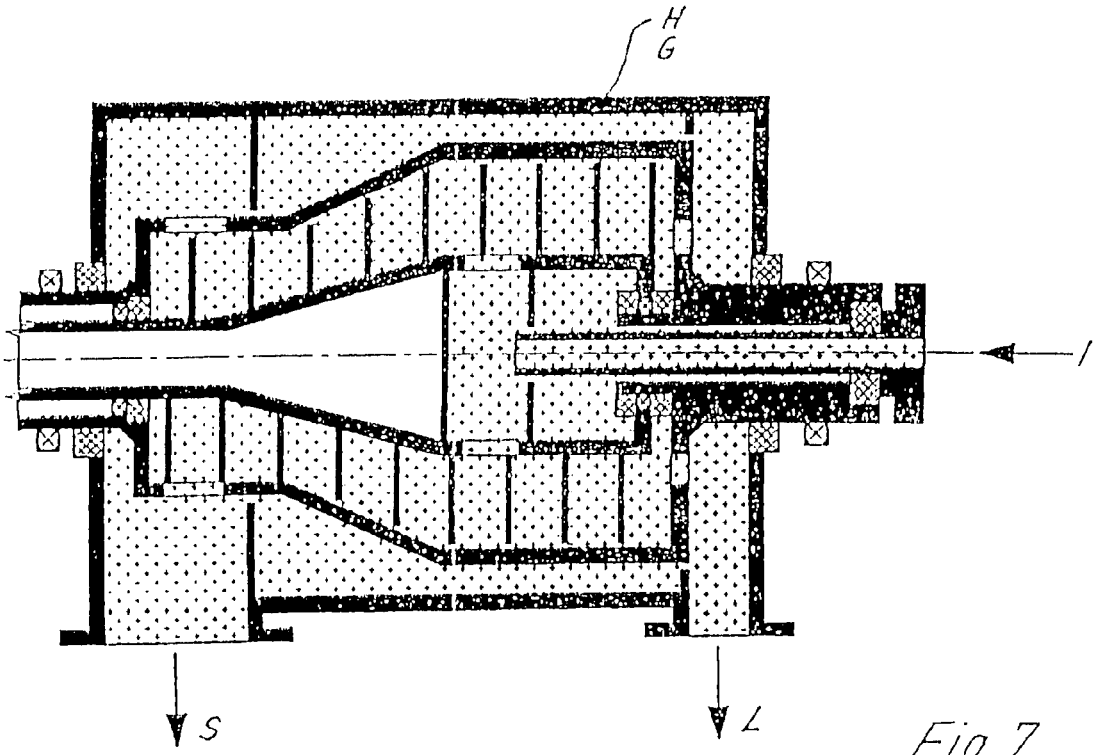
Fig. 7 PRIOR ART
FIG. 7 is the solid bowl helical conveyor centrifuge from FIG. 6, with the high-pressure area indicated as a dotted area.

FIG. 6 illustrates a centrifuge according to the state of the art. Unlike the centrifuge according to the present invention, the entire drum is enclosed by a pressure-tight housing G, so that the entire interior and exterior space of the drum is under pressure during operation (FIG. 7).

What is claimed is:

1. A solid bowl helical conveyor centrifuge having the following:

a rotating pressure tight drum, which includes a centrifuge space with a rotatable screw;

an inlet tube for supplying a material for centrifugation into the centrifuge space;

at least one liquid discharge and at least one solids discharge;

wherein the liquid discharge and/or the solid discharge having at least one or more openings in rotating part of the solid bowl helical conveyor centrifuge, in particular through openings in the drum wall, wherein the liquid discharge is a scraper disc;

wherein a portion including the area of the opening at the solid discharge is covered with a pressure tight housing; and wherein between the housing and the drum at least one gasket is provided.

2. The solid bowl helical conveyor centrifuge according to claim 1, wherein the gaskets are bearing ring gaskets.

3. The solid bowl helical conveyor centrifuge according to claim 1, wherein at least one of the openings is in an axial end face of the drum wall.

4. The solid bowl helical conveyor centrifuge according to claim 1, wherein at least one of the openings is in the circumferential wall of the drum and points radially outward.

5. The solid bowl helical conveyor centrifuge according to claim 1, wherein the pressure tight housing extends over the area of the openings on the drum.

6. The solid bowl helical conveyor centrifuge according to claim 1, wherein the the pressure tight housing is in the form of a ring.

7. The solid bowl helical conveyor centrifuge according to claim 1, wherein the gaskets are arranged between the inside circumference of the axial wall of the housing and that of the drum.

8. The solid bowl helical conveyor centrifuge according to claim 1, wherein the at least one housing is designed with a step and extends over a step of the drum.

9. The solid bowl helical conveyor centrifuge according to claim 1, wherein the at least one housing cannot rotate.

10. The solid bowl helical conveyor centrifuge according to claim 1, wherein at least one of the openings is a solids discharge in or connected to a tapered section of the drum.

11. The solid bowl helical conveyor centrifuge according to claim 1, wherein the scraper disk is arranged in a chamber of the drum, adjacent to the centrifuge space.

12. The solid bowl helical conveyor centrifuge according to claim 11, wherein the chamber is connected to the drum by at least one opening.

13. The solid bowl helical conveyor centrifuge according to claim 1, wherein one of the gaskets is between the drumhead and stationary scraper disk.

14. The solid bowl helical conveyor centrifuge according to claim 1, wherein the at least one housing is pressurized and operates at more than 0.5 bar, preferably 3 to 6 bar.

15. The solid bowl helical conveyor centrifuge according to claim 1, wherein the peripheral speed of the gaskets is greater than 30 m/sec.

16. The solid bowl helical conveyor centrifuge according to claim 1, wherein the temperature during processing of material for centrifugation in an area which is pressurized is more than 50° C., preferably 100° C. to 160° C.

17. The solid bowl helical conveyer centrifuge according to claim 1, wherein the liquid discharge is covered with a pressure tight housing.

18. A solid bowl helical conveyor centrifuge having the following:

a rotating pressure tight drum, which includes a centrifuge space with a rotatable screw;

an inlet tube for supplying a material for centrifugation into the centrifuge space;

at least one liquid discharge and at least one solids discharge;

wherein the liquid discharge and/or the solid discharge having at least one or more openings in rotating part of the solid bowl helical conveyor centrifuge, in particular through openings in the drum wall;

wherein a portion including the area of the opening at the solid discharge is covered with a pressure tight housing; wherein between the housing and the drum at least one gasket is provided; and wherein at least one of the openings is a liquid discharge in the form of an overflow opening in the end face of the drum facing away from the solids discharge, whereby this at least one overflow opening is covered by one of the housings.

19. A solid bowl helical conveyor centrifuge having the following:

a rotating pressure tight drum, which includes a centrifuge space with a rotatable screw;

an inlet tube for supplying a material for centrifugation into the centrifuge space;

at least one liquid discharge and at least one solids discharge;

wherein the liquid discharge and/or the solid discharge having at least one or more openings in rotating part of the solid bowl helical conveyor centrifuge, in particular through openings in the drum wall;

wherein a portion including the area of the opening at the solid discharge is covered with a pressure tight housing;

wherein between the housing and the drum at least one gasket is provided; and wherein one of the gaskets is in contact with the axial end face of the drum and another of the gaskets is in contact with a cylindrical drum head, which is adjacent to the outside wall of the drum.

* * * * *